US006132031A

United States Patent [19]

Watanabe

[11] Patent Number: 6,132,031

[45] Date of Patent: Oct. 17, 2000

[54] INK-JET HEAD, INK-JET CARTRIDGE AND INK-JET PRINTING APPARATUS

[75] Inventor: Yasutomo Watanabe, Hiratsuka, Japan

[73] Assignee: Canon Kabushiki Kaisha, Tokyo, Japan

[21] Appl. No.: 08/999,138

[22] Filed: Dec. 29, 1997

[30] Foreign Application Priority Data

Dec. 26, 1996 [JP] Japan ..... 8-347326
Dec. 18, 1997 [JP] Japan ..... 9-349703

[51] Int. Cl.[7] ..... B41J 2/05

[52] U.S. Cl. ..... 347/58; 347/59

[58] Field of Search ..... 347/56, 57, 58, 347/59, 65

[56] References Cited

U.S. PATENT DOCUMENTS

| | | | |
|---|---|---|---|
| 4,463,359 | 7/1984 | Ayata et al. | 347/56 |
| 4,740,796 | 4/1988 | Endo et al. | 347/56 |
| 5,243,363 | 9/1993 | Koizumi et al. | 347/58 |
| 5,648,804 | 7/1997 | Keefe et al. | 347/65 |

*Primary Examiner*—John Barlow
*Assistant Examiner*—Juanita Stephens
*Attorney, Agent, or Firm*—Fitzpatrick, Cella, Harper & Scinto

[57] ABSTRACT

In order to simply form individual wiring and common wiring in single layer, single layer of individual wiring and common wiring connected to heating resistors are formed. Electrode connected to common wiring is located at a position closer to the heating resistor than electrodes connected to the individual wiring.

15 Claims, 16 Drawing Sheets

INK-JET HEAD, INK-JET CARTRIDGE AND INK-JET PRINTING APPARATUS

This application is based on Patent Application Nos. 08-347,326 filed Dec. 26, 1996 and 09-349,703 filed Dec. 18, 1997 in Japan, the content of which is incorporated fereinto by reference.

BACKGROUND OF THE INVENTION

1. Field of the Invention

The present invention relates to an ink-jet head to be used for ejecting an ink for printing an image on a printing medium, an ink-jet cartridge and an ink-jet printing apparatus.

2. Description of the Related Art

An ink-jet printing system is capable of high speed and high density printing. The ink-jet printing system is also suitable for color printing and for down-sizing. Thus, such ink-jet printing system is attracting attention in the recent years.

An ink-jet printing apparatus employing such printing system has an ink-jet head 1001 and a driver mounting substrate 2001, as shown in FIGS. 10 and 11. The ink-jet head 1001 is constructed with a substrate 10, in which heating resistors (electrothermal transducer) 100 for ejecting ink droplets, a nozzle wall forming an ink passage, wiring patterns 110 and 120 (hereinafter simply referred to as "wiring") electrically connected to the heating resistors 100, an external lead electrodes 30 and so on. On the other hand, on the driver mounting substrate 2001, external lead electrodes 50 electrically connected to the external lead electrodes 30, wiring patterns 130 and 140 (hereinafter simply referred to as "wiring") and drivers IC60 for controlling the heating resistors 100 connected to the wiring 130 and 140.

The wiring formed in the ink-jet head 1001 includes individual wirings 110 and a common wiring 120. Each individual wiring 110 is formed corresponding to each heating resistor 100, one end of which is connected to one end of the corresponding heating resistor 100. The other end of each individual wiring 110 is connected to the corresponding one of external lead electrodes 30.

On the other hand, the common wiring 120 is commonly connected to the other ends of a plurality of the heating resistors 100 at one end. The other end of the common wiring 120 is connected to the corresponding external lead electrodes 30. On the other hand, a plurality of the external lead electrodes 50 of the driver mounting substrate 2001 are formed corresponding to external lead electrodes 30 of the ink-jet head 1001, respectively. To respective of those external lead electrodes 50, the individual wirings 130 and the common wirings 140 are connected.

Accordingly, each individual wiring 110 is connected to the driver IC60 for individually supplying power to the heating resistor 100 through the external lead electrodes 30 and 50 and the individual wiring 130. On the other hand, the common wiring 120 is connected to a power source via the external lead electrodes 30 and 50 and the common wiring 140. Accordingly, the common wiring 120 is commonly connected to a plurality of heating resistors 100 for permitting supply of a large current.

The individual wirings 110 and 130 are formed corresponding to the heating resistors 100. Normally, the individual wirings 110 and 130 are formed in the same interval as that of the heating resistors 100. Namely, the individual wirings 110 and 130 are formed in the interval of 200 DPI to 1200 DPI corresponding to nozzles. Under the premise of such interval, the layer thickness of the individual wirings 110 and 130 are determined for achieving easiness of manufacturing of the ink-jet head, electrical property and reliability of the heating resistor portion. Property required for the individual wirings 110 and 130 is as follow.

A. Reduction of Wiring Resistance

In order to increase proportion of the power to be effectively supplied to the heating resistor 100 among a power supplied to the heating resistor 100, it is necessary to reduce resistance of the individual wirings 110 and 130 as much as possible.

B. In order to improve coverage of a protection layer in the vicinity of the heating resistor 100, it is necessary to make the layer thickness of the individual wirings 110 as thin as possible.

C. The ink-jet head 1001 or the driver mounting substrate 2001 are formed by photolithographic method for achieving high density of wiring. In order to form high density wiring, the layer thickness of the wiring has to be as thin as possible.

On the other hand, properties required for the common wiring 120 and 140 are as follows:

A'. Since power is supplied to a plurality of heating resistors 100, it is necessary to make cross-sectional area of the common wiring 120 and 140 as wide as possible in order to improve efficiency. Namely, it is necessary to make the layer thickness as thick as possible or to make the area as wide as possible.

Also, the external lead electrodes 30 and 50 are required the following requirement.

A". In order to certainly maintain reliability of electrical connection between the ink-jet head 1001 and the driver mounting substrate 2001, it is essential to consider mutual tolerance in assembling. Therefore, it is necessary to make the interval between the electrodes 30 and 50 as wide as possible.

For the above requirement, the individual wirings 110 and 130 are formed by thin film processing as photolithographic method, and the common wiring 120 and 140 are formed by plating or thick film processing. Also, the individual wirings 110 and the common wiring 120 are formed in multi-layer wiring.

However, the following problems are encountered in the conventional fabrication processes of the individual wirings 110 and 130 and the common wiring 120 and 140.

1. Since the fabrication processes of the individual wirings 110 and 130 and the common wiring 120 and 140 are different, fabrication process for fabricating the ink-jet head 1001 and the driver mounting substrate 2001 becomes complicate.
2. Since the individual wirings 110 and 130 and the common wiring 120 and 140 have to be formed in multi-layer wiring, an interlayer insulation layer having quite high reliability is required, and caused to lower yield in the fabrication process.
3. Shapes of the external lead electrodes 30 and 50 formed by plating or the like are bump shaped configuration, and the shapes of the common wiring 120 and 140 are line shape and have wide pattern area. Therefore, it is difficult to form the external lead electrodes 30 and 50 with a uniform height.

SUMMARY OF THE INVENTION

It is an object of the present invention to provide an ink-jet head, an ink-jet cartridge and an ink-jet printing apparatus, in which individual wiring and common wiring can be formed simply with single layer wiring.

In a first aspect of the present invention, there is provided an ink-jet head having a plurality of printing elements respectively corresponding to a plurality of ink ejection openings, capable of ejecting ink droplets through the ink ejection openings by inputting a drive signal to both ends of the printing element, characterized in that individual wiring individually connected to one ends of respective of the printing elements and common wiring commonly connected to other ends of respective of the printing elements are formed in a single layer on a substrate;

electrodes connected to respective of the individual wiring and the common wiring are provided on the substrate; and the electrode connected to the common wiring is located at closer position to the printing elements than the electrodes connected to the individual wiring.

In a second aspect of the present invention, there is provided an ink-jet cartridge comprising:

the ink-jet head in the first aspect of the present invention and an ink tank supplying an ink to the ink-jet head.

In a third aspect of the present invention, there is provided an ink-jet printing apparatus printing an image on a printing medium employing an ink-jet head capable of ejection of an ink, comprising:

the ink-jet head in the first aspect of the present invention and shifting means for shifting the ink-jet head relative to the printing medium.

In a fourth aspect of the present invention, there is provided an ink-jet printing apparatus for printing an image on a printing medium employing an ink-jet head capable of ejecting an ink, comprising;

the ink jet cartridge in the second aspect of the present invention and shifting means for shifting the ink-jet head relative to the printing medium.

With the present invention, the individual wirings and the common wiring connected to printing elements are formed in single layer, on a substrate of the ink-jet head. Also, the electrodes connected to the common wiring are arranged at a position closer to the printing element than the electrodes connected to the individual wirings are. Thus, the individual wirings and the common wiring can be formed simply, and the common wiring can be set short to satisfy electrical requirement of the common wiring.

The above and other objects, effects, features and advantages of the present invention will become more apparent from the following description of embodiments thereof taken in conjunction with the accompanying drawings.

BRIEF DESCRIPTION OF THE DRAWINGS

FIGS. 2A to 2C are illustrations for explaining a wiring structure in the first embodiment according to the present invention, in which FIG. 2A is a circuit diagram of the wiring, FIG. 2B is a plan view of the ink-jet head corresponding to the wiring circuit portion of FIG. 2A, and FIG. 2C is a section taken along line X—X of FIG. 2B;

FIGS. 3A to 3C are illustrations for explaining a wiring structure of a driver mounting substrate in the first embodiment according to the present invention, in which FIG. 3A is a circuit diagram of the wiring, FIG. 3B is a plan view of the driver mounting substrate corresponding to the wiring circuit portion, and FIG. 3C is a section taken along line Y—Y of FIG. 3B;

DETAILED DESCRIPTION OF THE PREFERRED EMBODIMENT

The preferred embodiments of the present invention will be explained hereinafter with reference to the accompanying drawings.

First Embodiment

FIGS. 1 to 6 and 12 are illustrations for explaining the first embodiment of the present invention.

Figure 1:
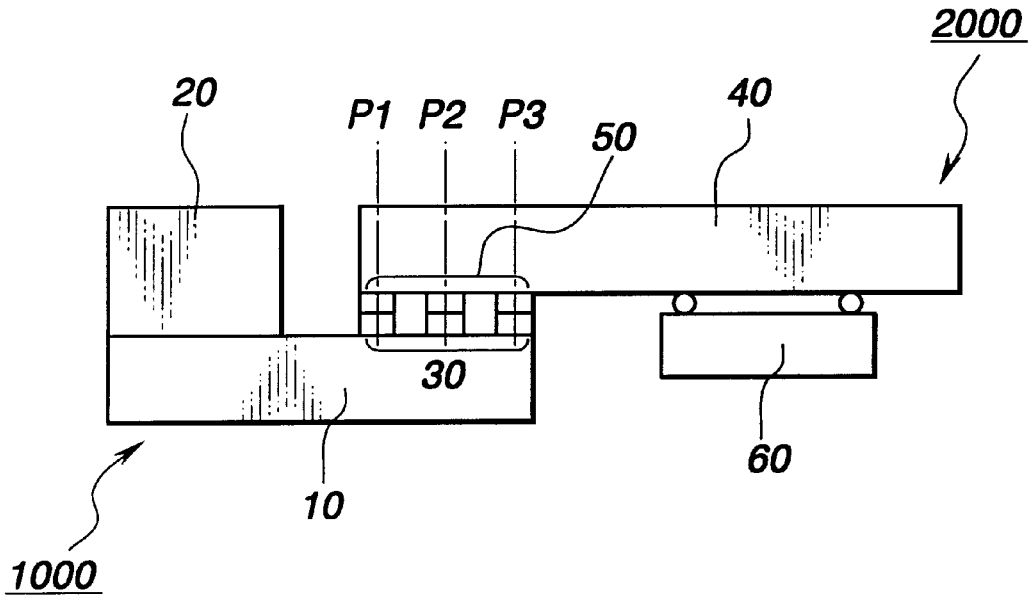
FIG. 1 is a side elevation showing the major part in the first embodiment of an ink-jet head according to the present invention.
Figure 2A:
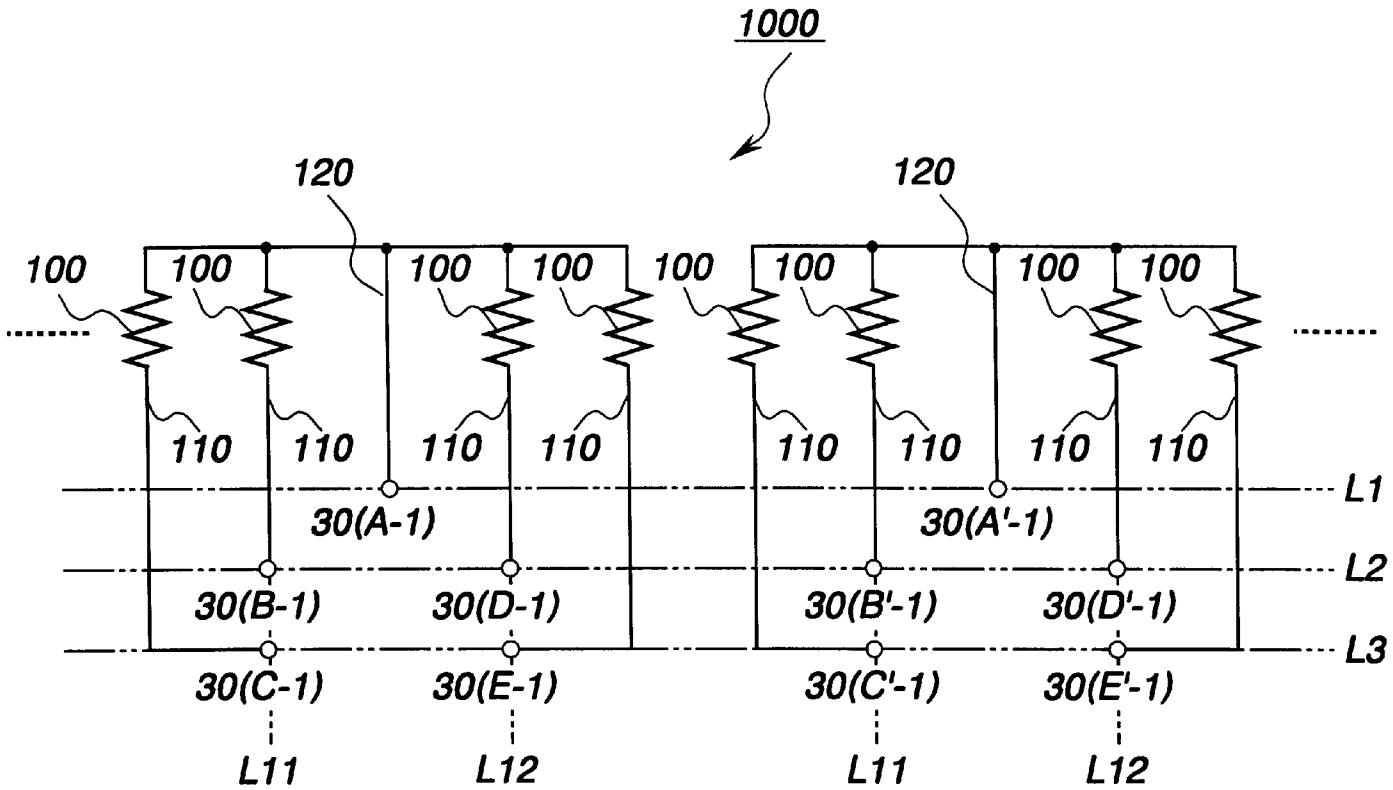
Figure 2B:
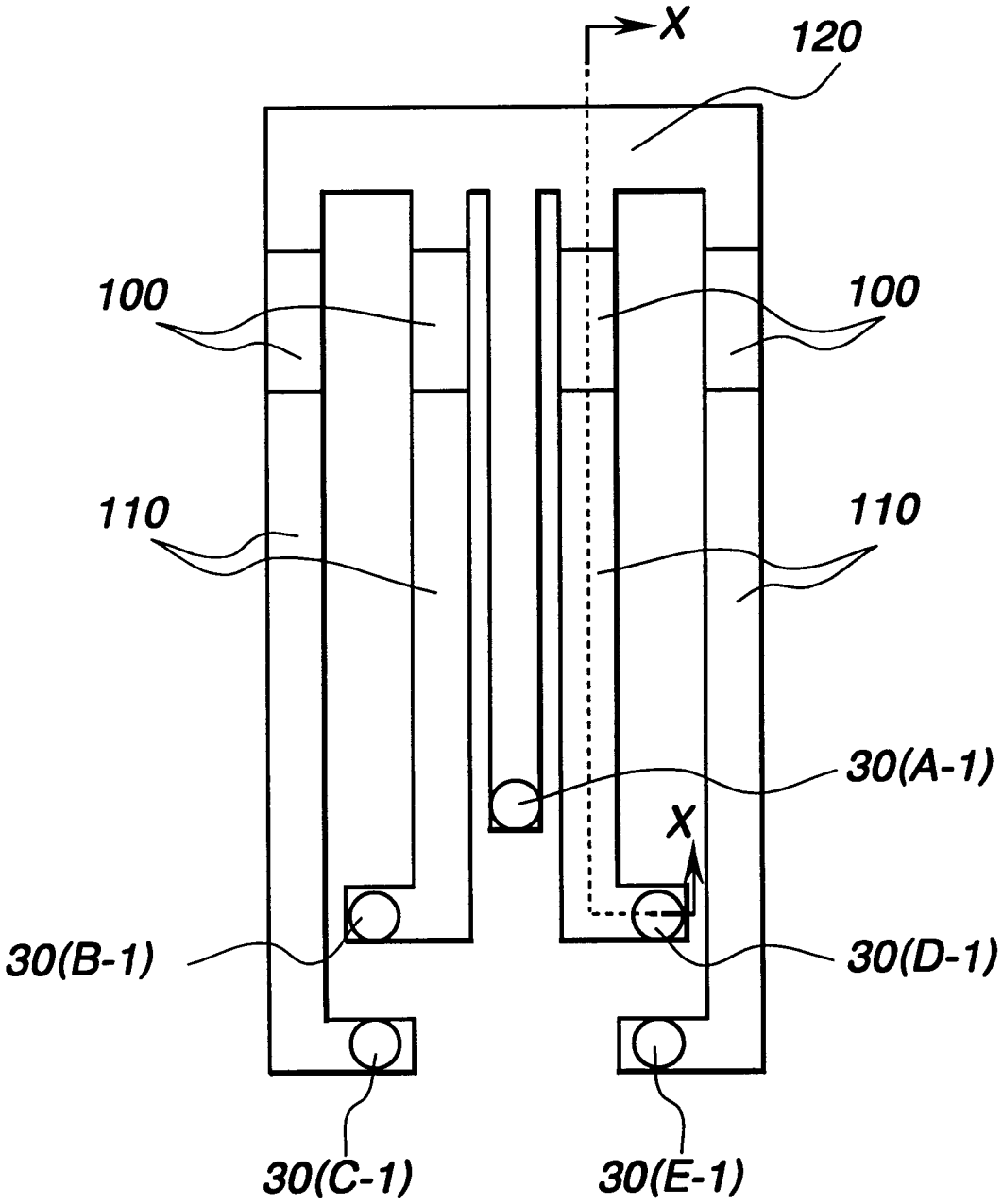
Figure 2C:
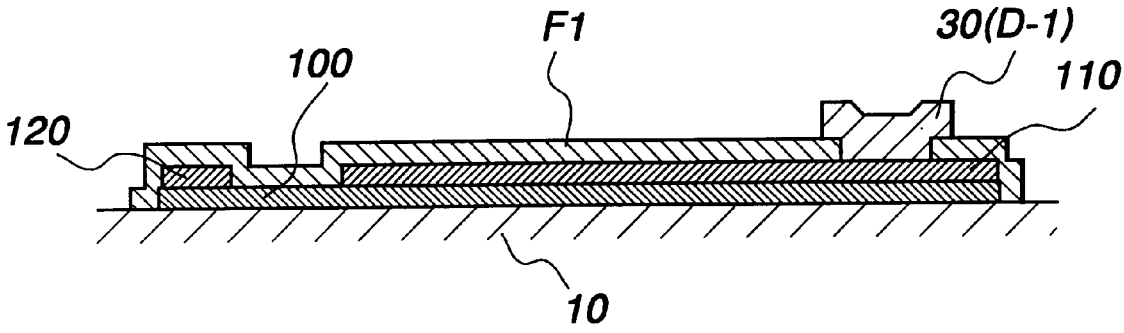

As shown in FIG. 1, an ink-jet head 1000 is constructed with at least a substrate 10 and an ink passage forming body 20. As shown in FIGS. 2A, 2B and 2C, on the substrate 10, a heat accumulating layer, heating resistors (electrothermal transducers) 100, individual wirings 110, common wirings 120 and external lead electrodes 30 are provided. FIG. 2A is a circuit diagram of wiring, FIG. 2B is a plan view of the ink-jet head corresponding to the wiring portion of FIG. 2A, and FIG. 2C is a section view taken along line X—X of FIG. 2B. In the ink passage forming body 20, ink chambers, orifice openings (ink ejection openings) and ink passages and the like are formed. Of course, in addition to the above, it is possible to provide a protection layer F1 or the like as an ink resistant layer an anti-cavitation layer of the heating resistor 100. The heating resistor 100 generates a heat by impression of an electrical pulse depending upon a driving data. By the heat, bubble is generated in the ink to eject the ink through the orifice opening attending with generation of the bubble. In the shown embodiment, respective of the external lead electrodes 30 are connected to the wiring 110 and 120 through through holes of the protection layer F1. On the upper surface of the external lead electrodes 30, recessed portions of the size corresponding to the through holes of the protection layer F1 are formed in the fabrication process.

Figure 3A:
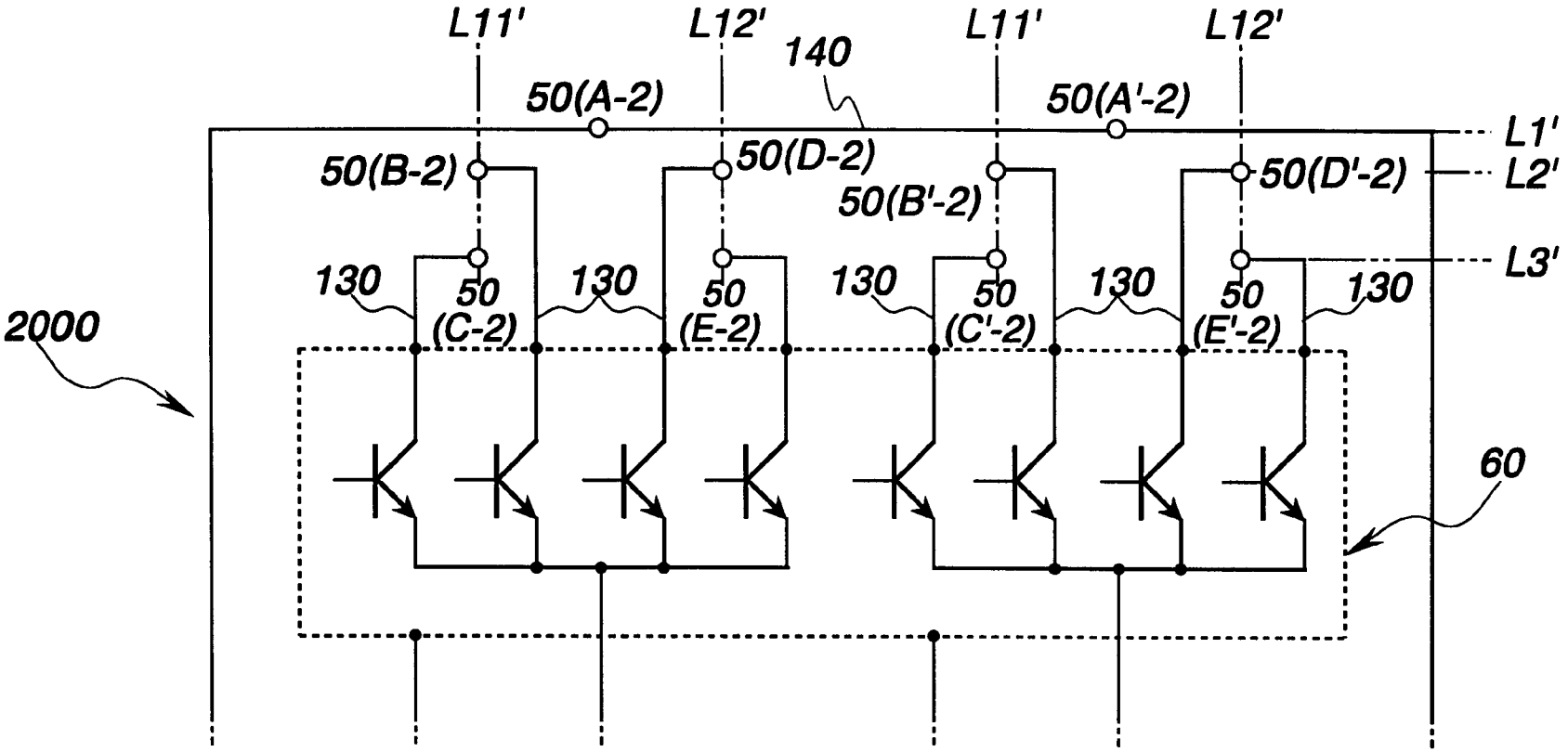
Figure 3B:
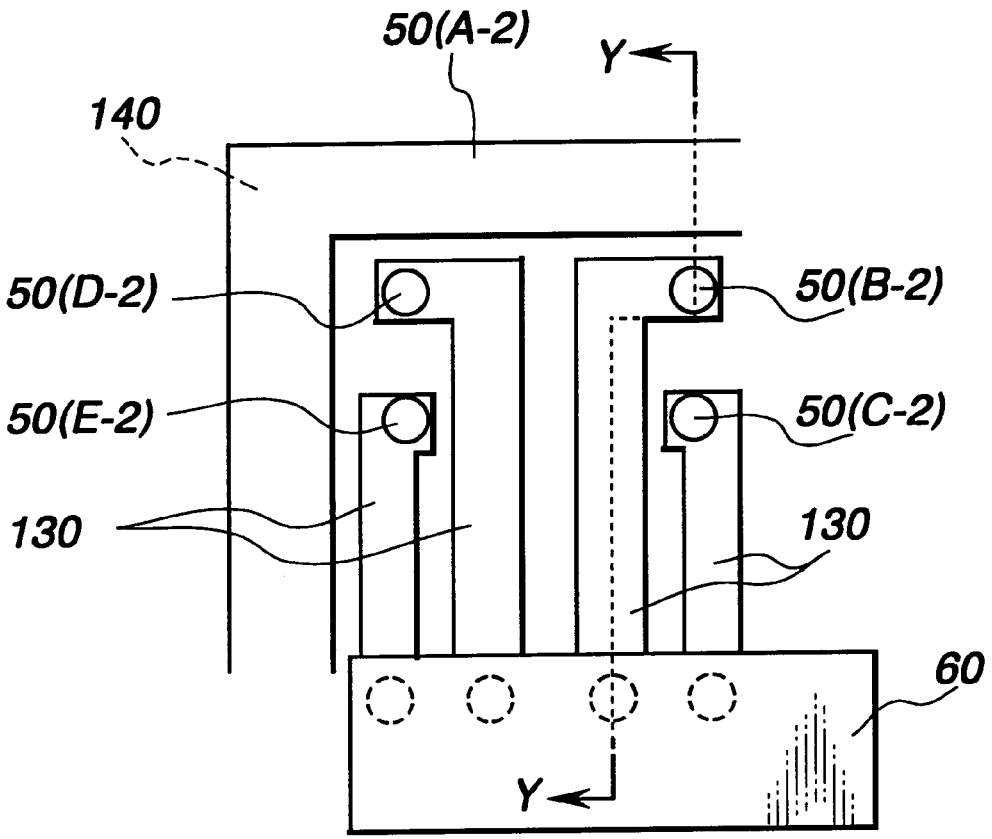
Figure 3C:
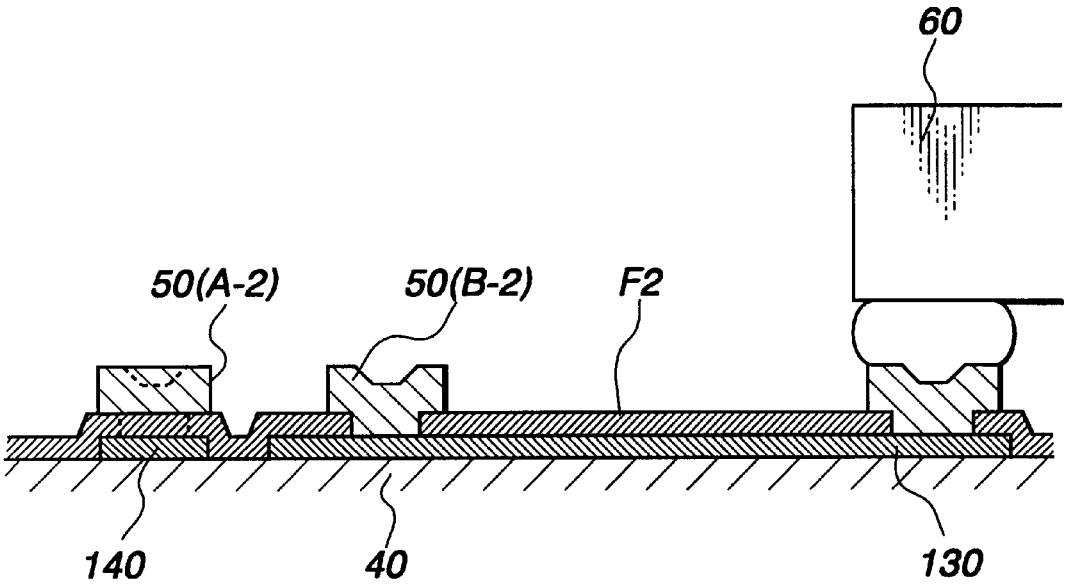

On the other hand, as shown in FIG. 1, FIGS. 3A, 3B and 3C, a driver mounting substrate 2000 is constructed with at least individual wirings 130, common wiring 140, external lead electrodes 50 and driver IC 60 forming driver circuits on a substrate 40. FIG. 3A is a circuit diagram of the wiring as looked through the driver mounting substrate 2000 from the upper surface at the upper side of FIG. 1. FIG. 3B is a plan view of the driver mounting substrate 2000 corresponding to the circuit portion of FIG. 3A as viewed from the lower surface at the lower side of FIG. 1, in which left and right sides are reversed against FIG. 3A. FIG. 3C is a section taken along line Y—Y of FIG. 3B. Of course, no problem will be arisen even when a protection layer F2 or the like are added on the wiring or the electrode. In the shown embodiment, respective of the external lead electrodes 50 are connected to the wiring 130 and 140 through through holes of the protection layer F2. On the upper surface of the external lead electrodes 50, recessed portions of the side corresponding to the through holes of the protection layer F2 are formed in the fabrication process. On the other hand, in case of the shown embodiment, the external lead electrode 50(A-2) connected to the common wiring 120 is formed as a stripe form printed pattern extending substantially along the common wiring 120.

In the driver IC 60, a plurality of driving transistors connected to the respective individual wirings 130, are provided. The driving transistors perform switching operation by a driving signal input to the base thereof.

In the ink-jet head 1000, a plurality of the heating resistors 100 are divided into a plurality of blocks and connected to the external lead electrodes 30 per the block. In FIG. 2A, suffixes A-1, B-1, C-1, D-1 and E-1 are added for the external lead electrodes 30 connected to the heating resistors 100 in the left side block, and suffixes A'-1, B'-1, C'-1, D'-1 and E'-1 are added for the external lead electrodes 30 connected to the heating resistors 100 in the right side block. Among these external lead electrodes 30, 30A-1 and 30A'-1 are connected to the common wiring 120 of the heating resistors 100. Other electrodes are connected to the individual wirings 110 of the heating resistors 100, respectively. The heating resistors 100 are formed at an interval corresponding to the nozzles, similarly to the prior art. The common wiring 120 extends toward right in FIG. 1 through the interval between the heating resistors 100. Accordingly, the common wiring 120 formed on the substrate 10 together with the heating resistors 100 are restricted the width thereof at small width. In FIG. 2A, the interval between the heating resistors 100, through which the common wiring 120 extends, is illustrated to be wider than that of other interval.

The external lead electrodes 30 are arranged in alignment along three rows (lines L1, L2 and L3 of FIG. 2A) in the back and forth (perpendicular) direction of the drawing surface of FIG. 1, at positions P1, P2 and P3 which sequentially increase distance from the heating resistor 100. Hereinafter, explanation will be given with taking the arrangement of the external lead electrodes 30 (A-1, B-1, C-1, D-1 and E-1), as example. The electrode 30(A-1) connected to the common wiring 120 is located on the line L1 in the position P1 (see FIG. 1) closest to the heating resistor 100. Among electrodes 30 connected to the individual wiring 110, half in number of electrodes 30(B-1) and 30(D-1) are located on the line L2 in the position P2 (see FIG. 1) next closest to the heating resistor 100. Other electrodes 30(C-1) and 30(E-1) are located on the line L3 in the position P3 (see FIG. 1) most distant from the heating resistor 100. Furthermore, the electrodes 30(B-1) and 30(C-1) are located on a common line L11 extending perpendicular to the arrangement direction (lateral direction of FIG. 1) of the heating resistors 100. The electrodes 30(D-1) and 30(E-1) are located on a common line L12 extending perpendicular to the arrangement direction (lateral direction of FIG. 1) of the heating resistors 100.

On the other hand, in the driver mounting substrate 2000, the external lead electrodes 50 are arranged corresponding to the external lead electrodes 30 on the side of the ink-jet head 2000. In FIG. 3A, the external lead electrodes 50 corresponding to the external lead electrodes 30(A-1), 30(B-1), 30(C-1), 30(D-1) and 30(E-1) on the ink-jet head 2000 of FIG. 2A, are respectively identified with suffixes A-2, B-2, C-2, D-2 and E-2. Similarly, the external lead electrodes 50 corresponding to the external lead electrodes 30(A'-1), 30(B'-l), 30(C'-l), 30(D'-1) and 30(E'-1) on the ink-jet head 2000 of FIG. 2A, are respectively identified with suffixes A'-2, B'-2, C'-2, D'-2 and E'-2. Among these electrodes 50, the external lead electrodes 50(A-2) and 50(A'-2) are connected to the common wiring 140, and other electrodes are connected to the individual wirings 130. On the other hand, in FIG. 3A, the lines corresponding to the lines L1, L2 and L3 (see FIG. 2A) are represented by L1', L2' and L3', and similarly, the lines corresponding to the lines L11 and L12 (see FIG. 2A) are represented by L11' and L12'. The lines L1', L2' and L3' are arranged to positions closer to the driver IC 60, in the sequential order.

The common wiring 140 is connected to a common power source. On the other hand, the individual wirings 130 are connected to the driving portions of the corresponding driver ICs 60 corresponding to the heating resistors 100, respectively.

Thus, the external lead electrodes 30 on the head 1000 side and the external lead electrodes 50 on the substrate 2000 side are arranged correspondingly. These external lead electrodes 30 and 50 are connected for contacting with each other, as shown in FIG. 1.

On the other hand, the common wirings 120 on the head 1000 are restricted in the narrow width, as set forth above. The electrodes 30(A-1) and 30(A'-1) connected to the common wirings 120 are arranged on the line L1 closest to the heating resistor 100. Thus, the common wiring 120 can be set to have shorter length in the vertical direction in FIG. 2A. As a result, the electrical resistance of the common wiring 120 which is restricted in the width and the layer thickness, can be small.

On the other hand, the electrodes 50(A-2) and 50(A'-2) connected to the common wiring 140 on the substrate 2000 side, are arranged on the line L1' most distant from the driver IC 60. Therefore, the width of the common wiring 140 can be set large. Namely, on the substrate 2000, the upper side position of the driver IC 60 in FIG. 3A, has high density in the wiring condition, such as for individual wirings 130. The common wiring 140 can be formed to have a large width on the line L1' bypassing the high density wiring portion. Especially, the common wiring 140 can be formed to have a large width in the direction far from the driver IC 60. Further, the common wiring 140 extends to the lower side of FIG. 3A from line L1' through the portion far form the side of the driver IC 60. Therefore, the extending portion of the common wiring 140 can be formed to have a large width. As a result, the electrical resistance of the common wiring 140 can be set small. The common wiring 120 and 140 can be connected with small electrical resistance between the heating resistors 100 and the common power source.

On the other hand, respective electrodes 30 and 50 are arranged with offset on a plurality of rows (in case of the shown embodiment, respective three lines of lines L1, L2, L3 and L1', L2', L3'). Therefore, respective intervals of the electrodes 30 and 50 can be set relatively large to provide greater contact areas for respective electrodes 30 and 50. Furthermore, the electrodes 30 and 50 connected the individual wiring 110 and 130 are arranged on common lines extending perpendicular to alignment direction of the nozzles (direction of lines L11, L12 and L11', L12'), in such a manner that a plurality of the electrodes 30 and 50 are arranged on the same line (in case of the shown embodiment, two electrodes per line). Respective interval of the electrodes 30 and 50 can be set to be greater than the internal of the nozzles. Thus, wiring of respective wiring 110, 120, 130 and 140 can be facilitated.

On the substrates 10 and 40, respective wiring and respective electrodes are formed in single layer. As set forth above, it becomes possible to satisfy the requirement in formation of the wiring. On the other hand, the individual wiring 110 and 130 and the common wiring 120 and 140 can be formed in the formation process of the electrodes. Accordingly, significant effect can be achieved in shortening of the formation process and in improvement of the electrical characteristics.

Figure 4:
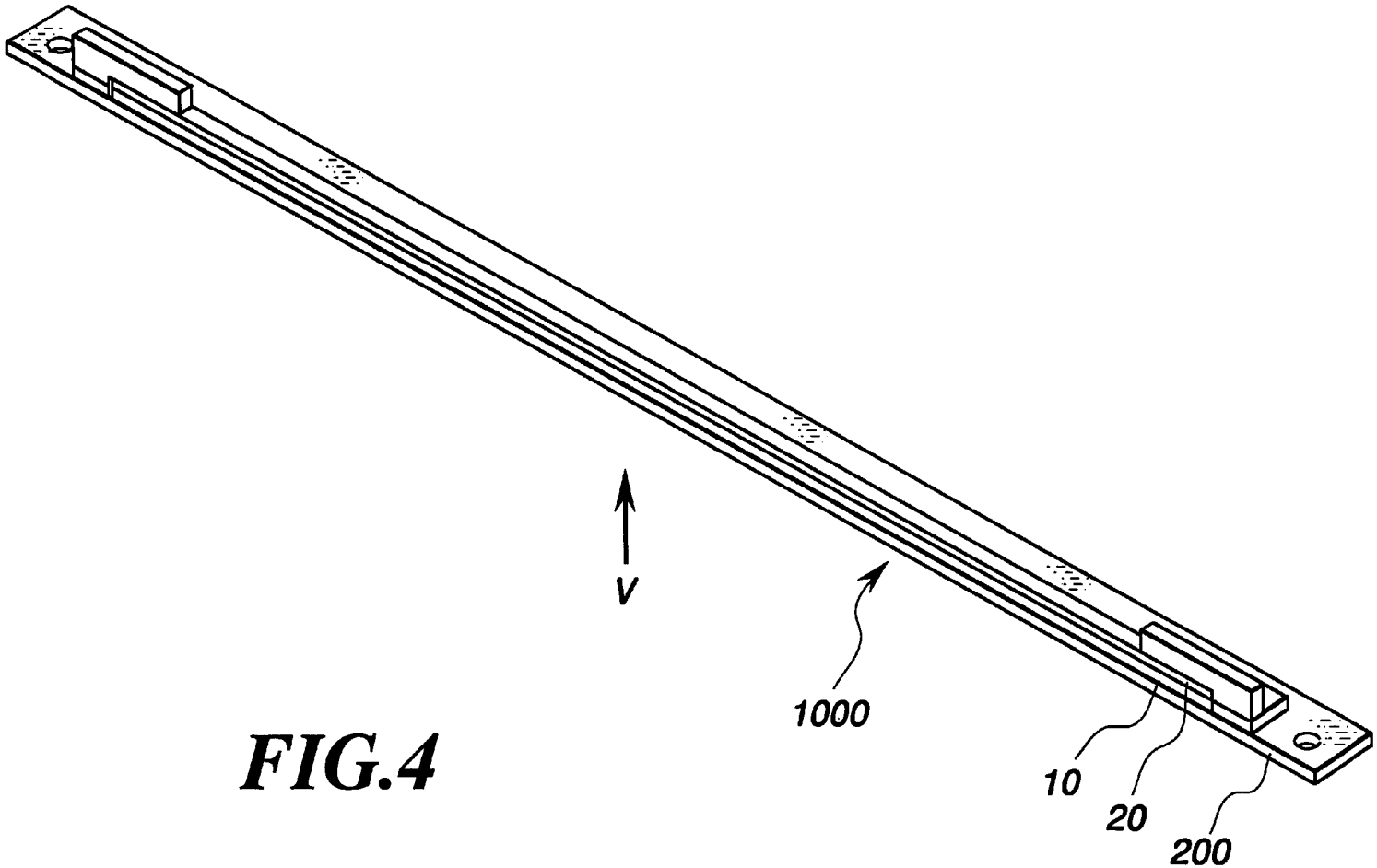
FIG. 4 is a perspective view in the first embodiment according to the present invention.
Figure 5:
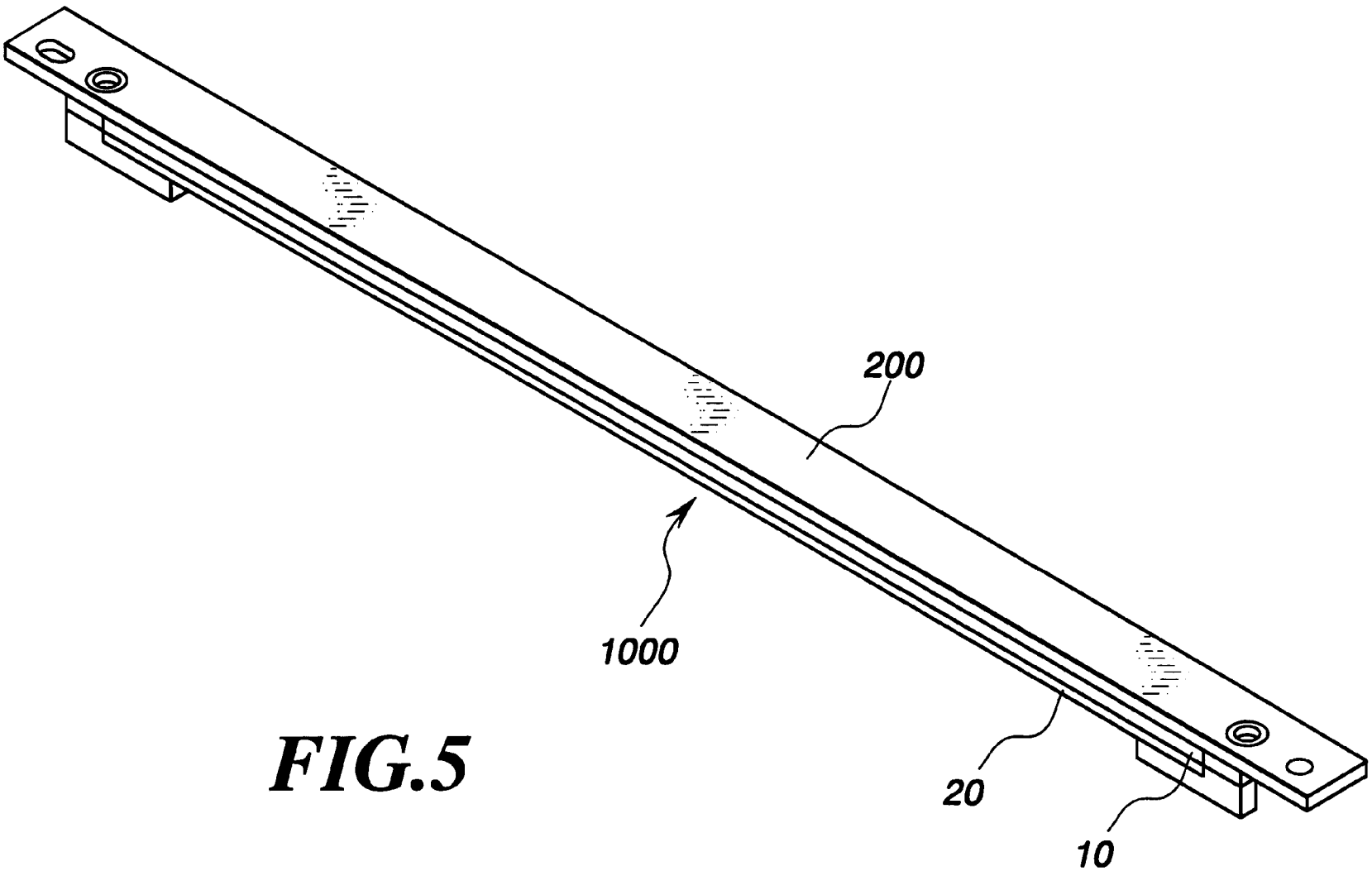
FIG. 5 is an illustration as viewed along an arrow V of FIG. 4.
Figure 6:
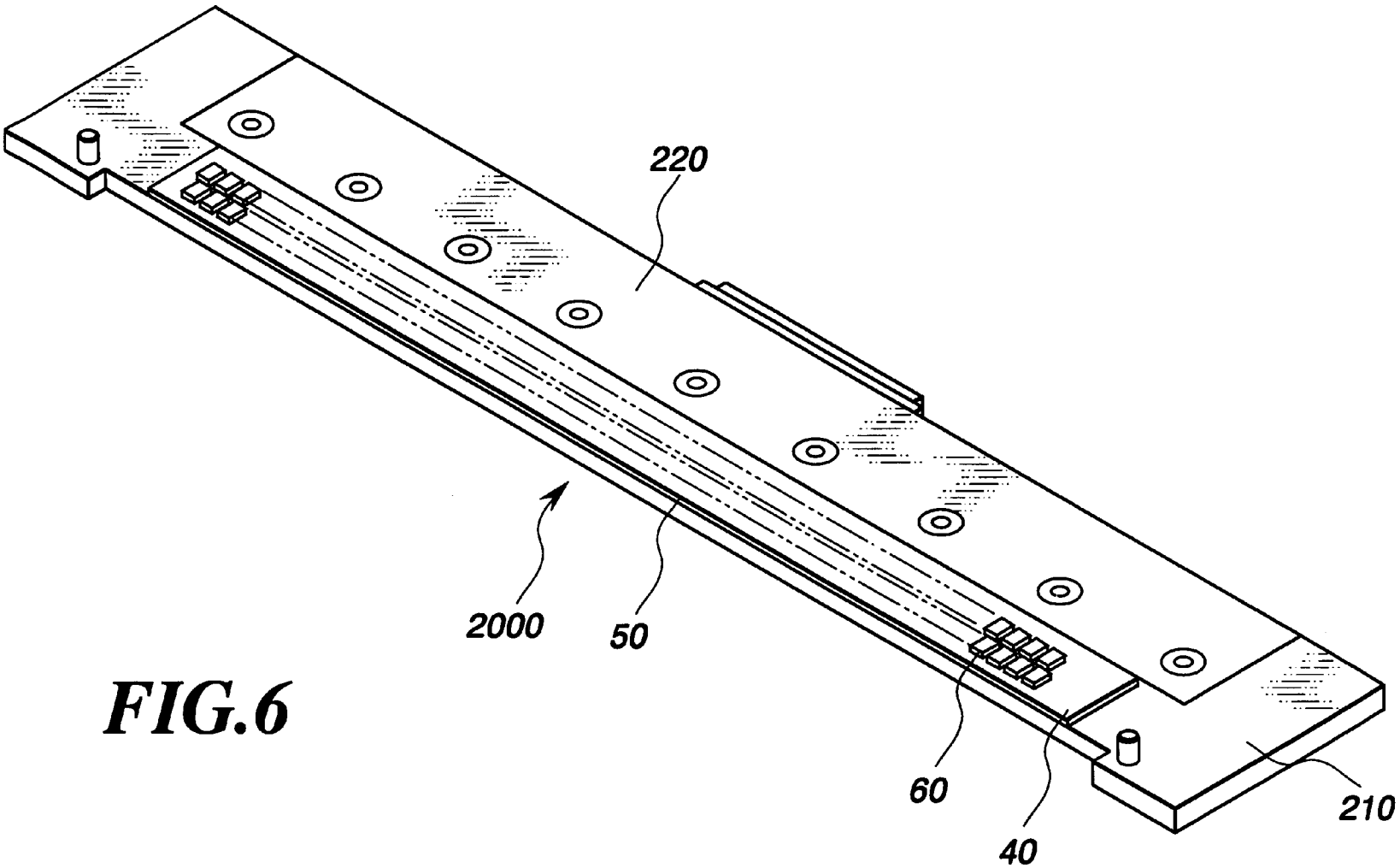
FIG. 6 is a perspective view of the driver mounting substrate in the first embodiment according to the present invention.

FIGS. 4 and 5 show an example of construction of the head 1000. The head 1000 is fixed to a support substrate 200. FIG. 6 shows an example of construction of the substrate 2000. The substrate 2000 is fixed to a support substrate 210. On the other hand, the substrate 2000 is connected to a relay substrate 220 for establishing connection with the ink-jet printing apparatus, by the way of wire bonding. Of course, a method of connection between the substrate 2000 and the relay substrate 220 is not specified to the method in the shown embodiment.

Figure 12:
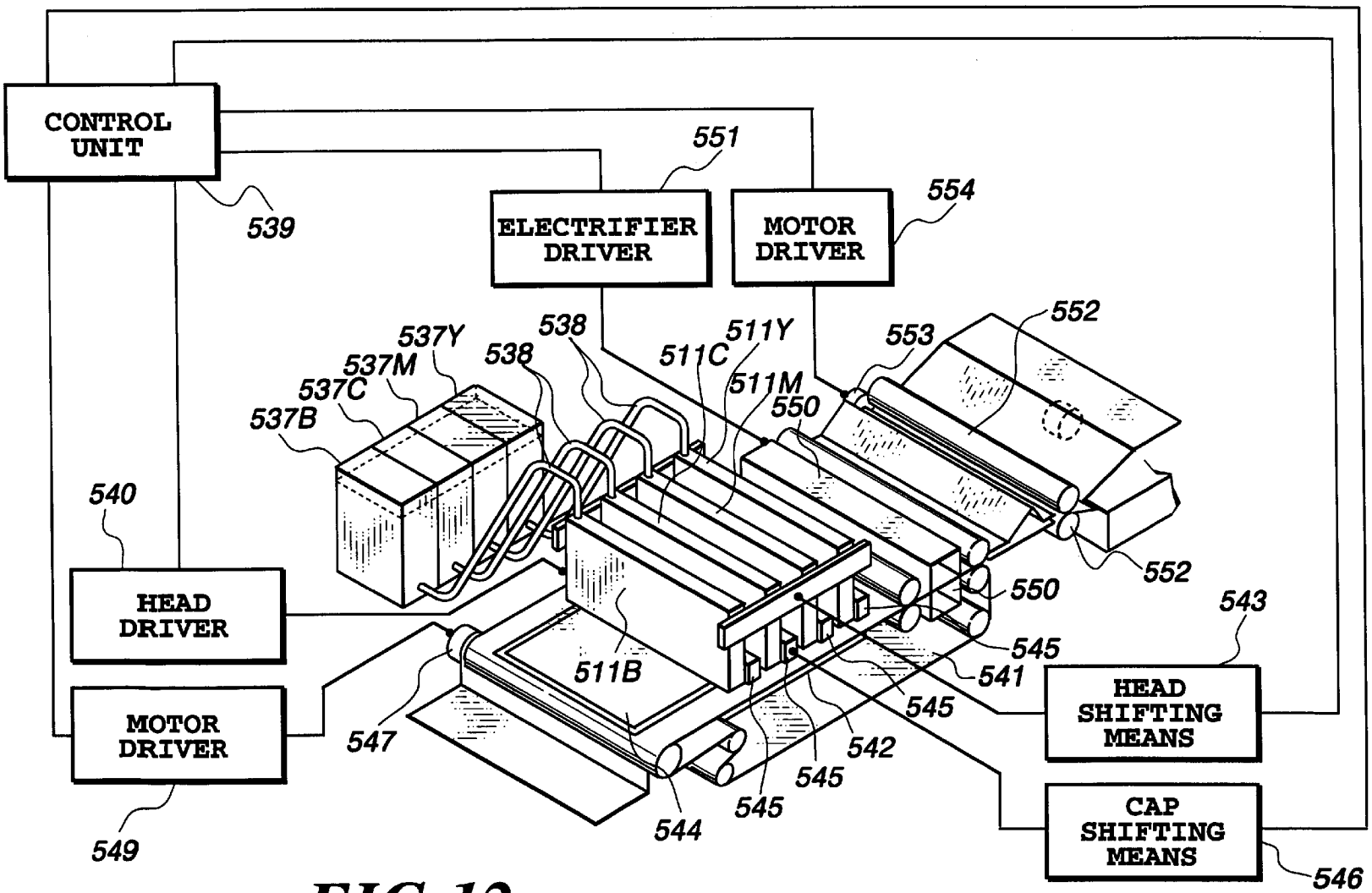
FIG. 12 is a perspective view of the major part of the preferred embodiment of an ink-jet printing apparatus according to the present invention.

FIG. 12 is a perspective view of the major part for explaining an embodiment of the construction of the ink-jet printing apparatus having the head 1000 and the substrate 2000 constructed as set forth above.

The shown embodiment of the ink-jet printing apparatus is a full color type color printer, in which an ink-jet cartridge is loaded. The ink-jet cartridge has ink tanks and ink-jet heads. The ink tank includes four ink tanks 537Y, 537M, 537C and 537B storing yellow color ink, magenta color ink, cyan color ink and black ink (hereinafter generally referred to as ink tank 537). The ink-jet heads includes four ink-jet heads 511Y, 511M, 511C and 511B (hereinafter generally referred to as ink-jet head 511) connected to the ink tanks 537 via connection tubes 538. Ink supply tubes of respective ink tanks 537 is exchangeably connected with the connection tubes 538.

By driving transistors of head drivers 540 connected to a control unit 539, power supply for the heating resistor of respective ink-jet heads 511 can be switched ON and OFF. Such ink-jet heads 511 are constructed including the above-mentioned head 1000 and the substrate 2000. Each ink-jet head 511 opposes a platen 542 across an endless transportation belt 541, and is arranged at a predetermined interval along transporting direction of the transporting belt 541. By head shifting means 543, operation of which is controlled by the control unit 539, each ink-jet head 511 is lifted up and down in the opposing direction relative to the platen 542. A head cap 545 provided on the side portion of each ink-jet head 511 is adapted for recovery process of the ink-jet head 511 by ejecting the old ink remained in the ink passage of each ink-jet head 511 through the ink ejection opening. For example, the recovery process is performed before printing operation for printing paper 544. The head cap 545 is located at a position shifted for half pitch of arrangement interval of the ink-jet head 511 from each head 511. By a cap shifting means 546, operation of which is controlled by the control unit 539, the head caps 545 are moved immediately below the ink-jet heads 511 to receive waste ink ejected from the ink ejection openings 524.

A transporting belt 541 transporting a printing paper 544 is wrapped around a driving roller 548 connected to a belt driving motor 547. The motor 547 is driven by a motor driver 549 connected to the control unit 539. On the upstream side of the transporting belt 541, an electrifier 550 charges the transporting belt 541 for firmly fitting the printing paper 544 on the transporting belt 541. Power supply for the electrifier 550 is switched ON and OFF by an electrifier driver 551 connected to the control unit 539. A pair of paper feeding rollers 552 supply the printing paper 544 on the transporting belt 541. To a pair of paper feeding rollers 552, a paper feeder motor 553 for rotatingly driving these is connected. The paper feeder motor 553 is driven by a motor driver 554 connected to the control unit 539.

Accordingly, in advance of printing operation for the printing paper 544, the ink-jet heads 511 are elevated away from the platen 542. Then, the head caps 545 are shifted to a position immediately below the ink-jet heads 511. Then, recovery process of the ink-jet heads 511 is performed. Subsequently, the head caps 545 are returned to the initial stand-by position, and the ink-jet heads 511 are moved to a printing position of the platen 542 side. Simultaneously with actuation of the electrifier 550, the transporting belt 541 is driven. Then, the printing paper 544 is supplied on the transporting belt 541 by the paper feeding rollers 552. Then, a desired color image is printed on the printing paper 544 by respective ink-jet heads 511.

Second Embodiment

Figure 7:
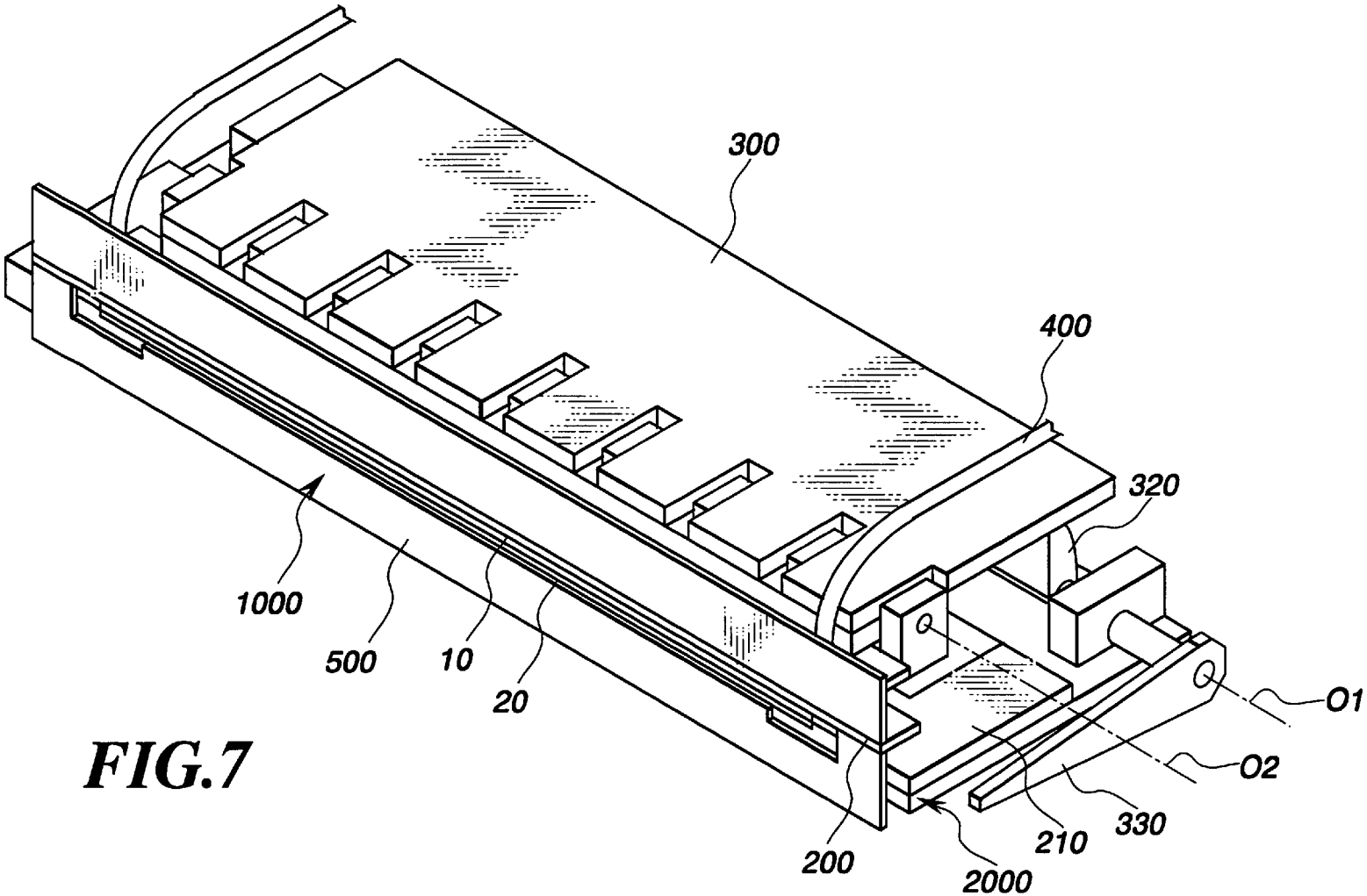
FIG. 7 is a perspective view of the major part in the second embodiment according to the present invention.
Figure 8A:
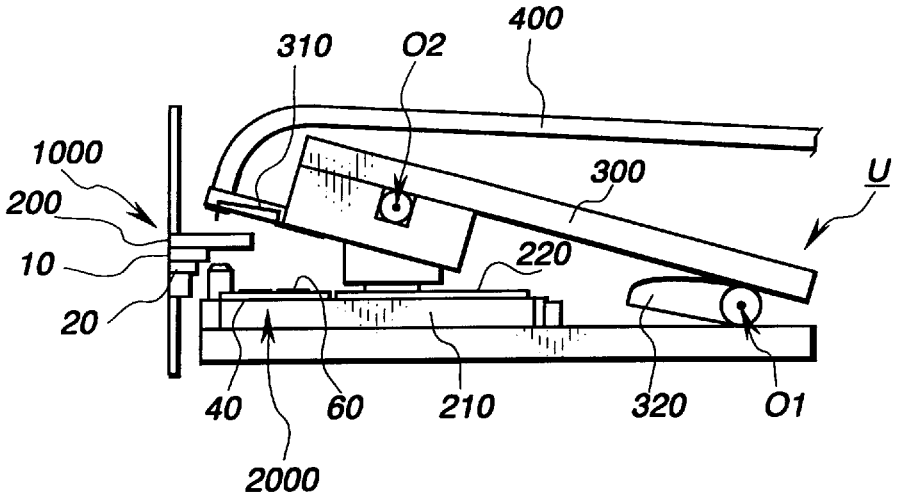
FIGS. 8A, 8B and 8C are illustrations for explaining operation of the major part in the second embodiment according to the present invention.
Figure 8B:
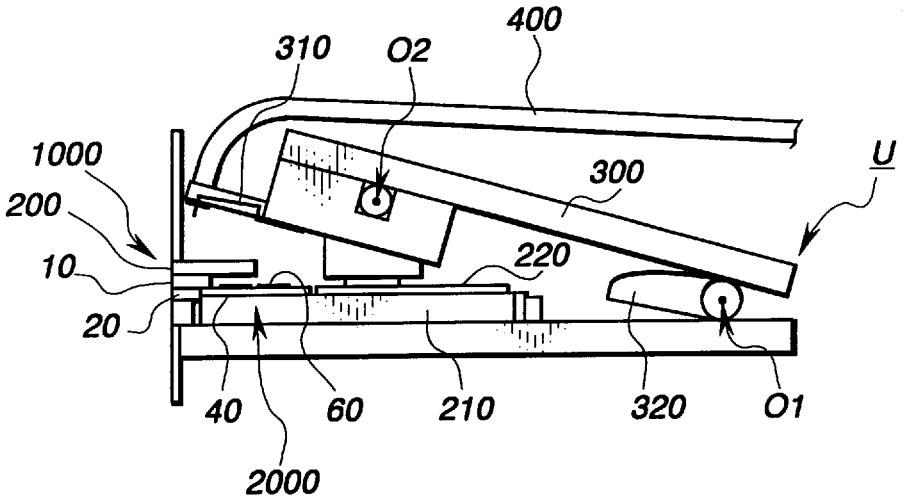
Figure 8C:
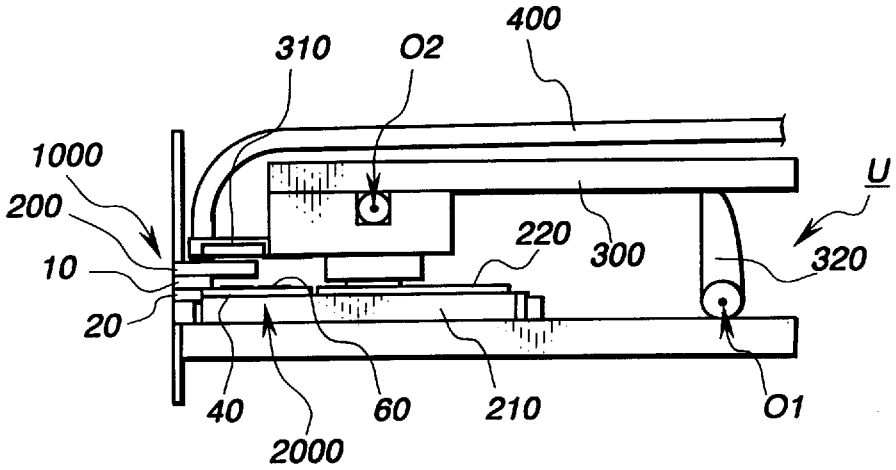
Figure 9:
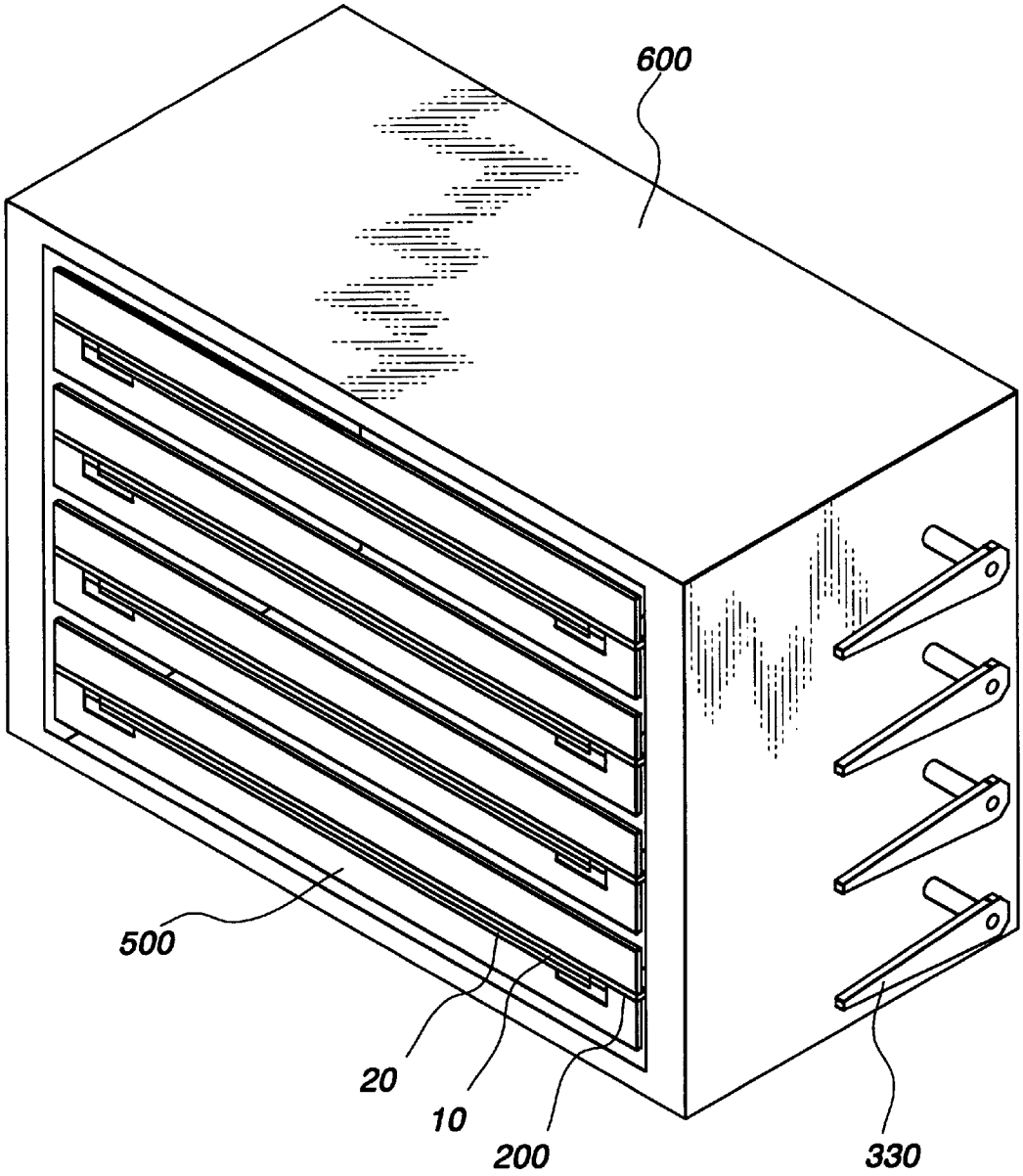
FIG. 9 is an external perspective view of the major part of the second embodiment according to the present invention.
Figure 10:
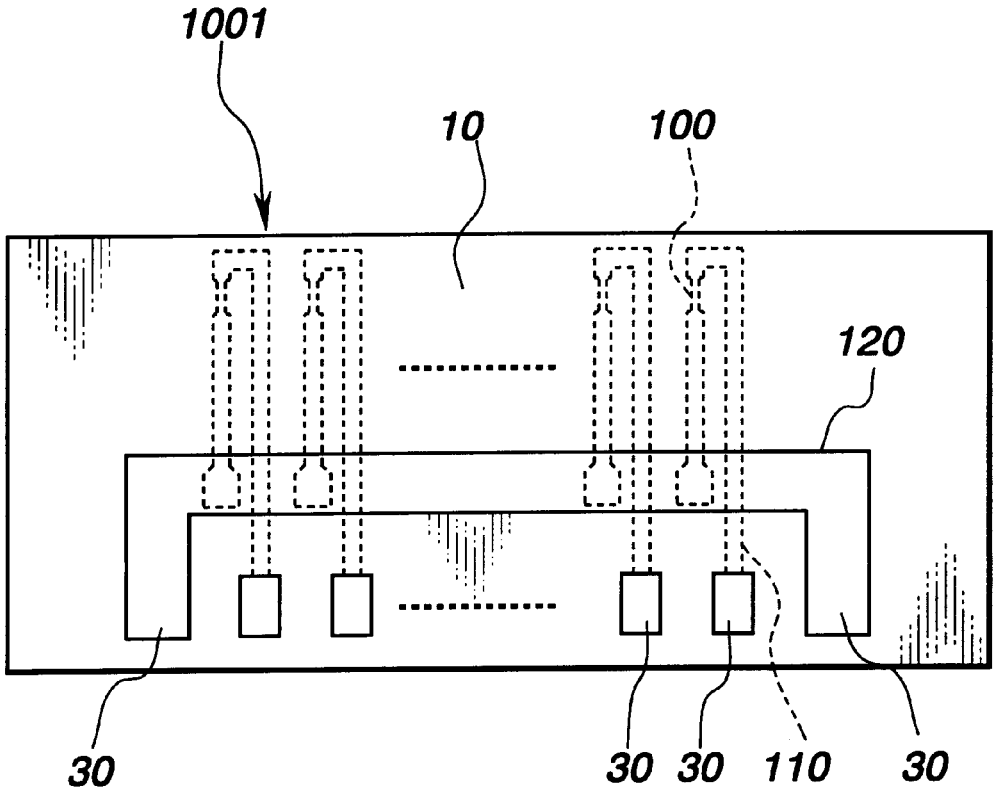
FIG. 10 is an illustration showing a circuit construction of the conventional ink-jet head.
Figure 11:
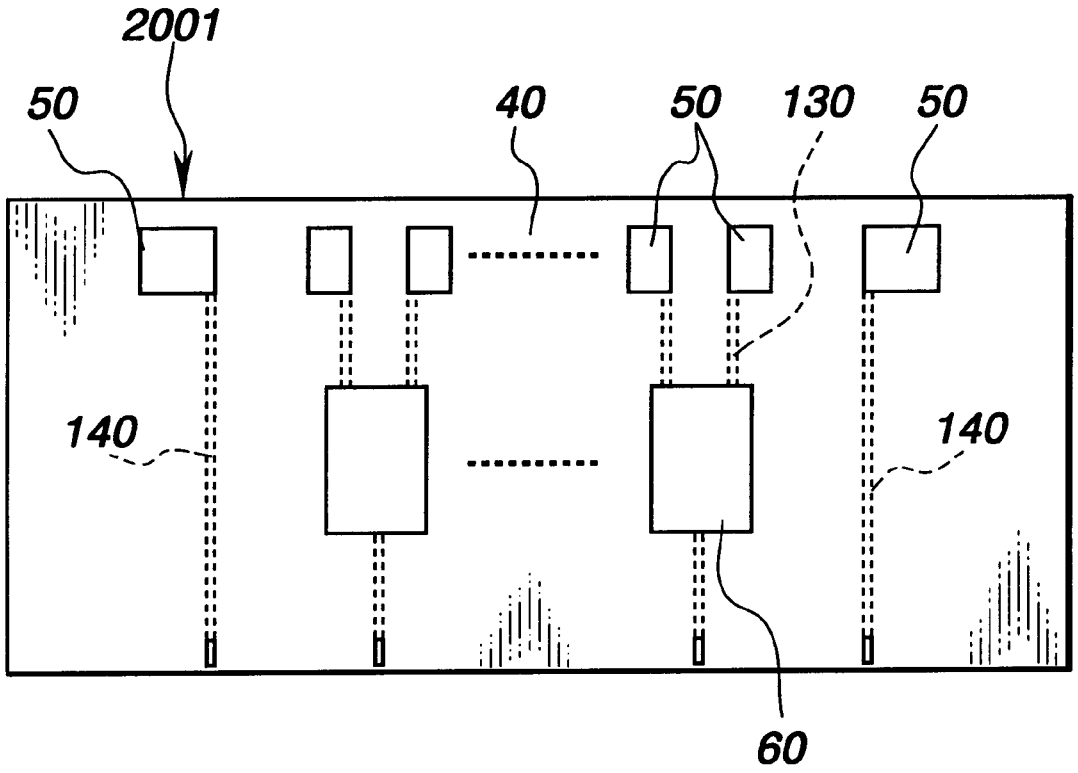
FIG. 11 is an illustration showing a circuit construction of the conventional driver mounting substrate.

FIGS. 7 to 9 are illustrations for explaining the second embodiment of the present invention.

In the shown embodiment, the ink jet head 1000 and the driver mounting substrate 2000 are mechanically crimped for establishing electrical connection to form an ink-jet head unit U. Upon connection of the ink-jet head 1000 and the driver mounting substrate 2000, the ink-jet head 1000 and the driver mounting substrate 2000 are positioned with opposing the external lead electrodes 30 and 50 (see FIG. 1), as shown in FIG. 8A. Subsequently, as shown in FIGS. 8B and 8C, a driving lever 320 of a crimp mechanism is pivoted about a pivot axis O1 to drive a driven lever 300 to pivot about a pivot axis O2. By this, the external lead electrodes 30 and 50 (see FIG. 1) of the ink-jet head 1000 and the driver mounting substrate 2000 can be held in a crimped condition. At the same time, to the ink-jet head 1000, ink supply tubes 400 for supplying ink to the ink chamber of the ink-jet head 1000 is connected. The reference numeral 310 denotes a leaf spring, 330 denotes a handle, 500 denotes a plate. With such crimp mechanism, the external lead electrodes 30 and 50 can be held in the crimped condition to establish electrical connection between the ink-jet head 1000 and the driver mounting substrate 2000.

FIG. 9 is an illustration for explaining an example of construction of the major part of the ink-jet printing apparatus including the ink-jet head unit U constructed as set forth above.

In the shown embodiment, there is shown a printing portion of a full color printing apparatus having four sets of the ink-jet head units U corresponding to four color inks. From each ink-jet head unit U, the corresponding color of the ink is ejected. The ink-jet head units U are arranged with a regular interval within a casing 600 of the printing apparatus. Upon installation and removal of the ink-jet head 1000, the handle 330 is operated. Upon removal of the ink-jet head 1000, the handle 330 is operated to release mechanical crimp of the foregoing crimp mechanism.

Of course, number of the ink-jet head units to be installed in the printing apparatus is not limited to four as in the shown embodiment but can be determined arbitrarily.

The present invention achieves distinct effect when applied to an ink-jet head (i.e., a recording head), an ink-jet cartridge or an ink-jet printing apparatus (i.e., a recording apparatus) which has means for generating thermal energy such as electrothermal transducers or laser light, and which causes changes in ink by the thermal energy so as to eject ink. This is because such a system can achieve a high density and high resolution recording.

A typical structure and operational principle thereof is disclosed in U.S. Pat. Nos. 4,723,129 and 4,740,796, and it is preferable to use this basic principle to implement such a system. Although this system can be applied either to on-demand type or continuous type ink jet recording systems, it is particularly suitable for the on-demand type apparatus. This is because the on-demand type apparatus has electrothermal transducers, each disposed on a sheet or liquid passage that retains liquid (ink), and operates as follows: first, one or more drive signals are applied to the electrothermal transducers to cause thermal energy corresponding to recording information; second, the thermal energy induces sudden temperature rise that exceeds the nucleate boiling so as to cause the film boiling on heating portions of the recording head; and third, bubbles are grown in the liquid (ink) corresponding to the drive signals. By using the growth and collapse of the bubbles, the ink is expelled from at least one of the ink ejection orifices of the head to form one or more ink drops. The drive signal in the form of a pulse is preferable because the growth and collapse of the bubbles can be achieved instantaneously and suitably by this form of drive signal. As a drive signal in the form of a pulse, those described in U.S. Pat. Nos. 4,463,359 and 4,345,262 are preferable. In addition, it is preferable that the rate of temperature rise of the heating portions described in U.S. Pat. No. 4,313,124 be adopted to achieve better recording.

U.S. Pat. Nos. 4,558,333 and 4,459,600 disclose the following structure of a recording head, which is incorporated to the present invention: this structure includes heating portions disposed on bent portions in addition to a combination of the ejection orifices, liquid passages and the electrothermal transducers disclosed in the above patents. Moreover, the present invention can be applied to structures disclosed in Japanese Patent Application Laying-open Nos. 123670/1984 and 138461/1984 in order to achieve similar effects. The former discloses a structure in which a slit common to all the electrothermal transducers is used as ejection orifices of the electrothermal transducers, and the latter discloses a structure in which openings for absorbing pressure waves caused by thermal energy are formed corresponding to the ejection orifices. Thus, irrespective of the type of the recording head, the present invention can achieve recording positively and effectively.

The present invention can be also applied to a so-called full-line type recording head whose length equals the maximum length across a recording medium. Such a recording head may consists of a plurality of recording heads combined together, or one integrally arranged recording head.

In addition, the present invention can be applied to various serial type recording apparatus. In this case, various recording heads can be used: for example, a recording head fixed to the main assembly of a recording apparatus; a conveniently replaceable chip type recording head which, when loaded on the main assembly of a recording apparatus, is electrically connected to the main assembly, and is supplied with ink therefrom; and a cartridge type recording head integrally including an ink reservoir.

It is further preferable to add a recovery system, or a preliminary auxiliary system for a recording head as a constituent of the recording apparatus because they serve to make the effect of the present invention more reliable. Examples of the recovery system are a capping means and a cleaning means for the recording head, and a pressure or suction means for the recording head. Examples of the preliminary auxiliary system are a preliminary heating means utilizing electrothermal transducers or a combination of other heater elements and the electrothermal transducers, and a means for carrying out preliminary ejection of ink independently of the ejection for recording. These systems are effective for reliable recording.

The number and type of recording heads to be mounted on a recording apparatus can be also changed. For example, only one recording head corresponding to a single color ink, or a plurality of recording heads corresponding to a plurality of inks different in color or concentration can be used. In other words, the present invention can be effectively applied to an apparatus having at least one of the monochromatic, multi-color and full-color modes. Here, the monochromatic mode performs recording by using only one major color such as black. The multi-color mode carries out recording by using different color inks, and the full-color mode performs recording by color mixing.

Furthermore, although the above-described embodiments use liquid ink, inks that are liquid when the recording signal is applied can be used: for example, inks can be employed that solidify at a temperature lower than the room temperature and are softened or liquefied in the room temperature. This is because in the ink jet system, the ink is generally temperature adjusted in a range of 30° C.–70° C. so that the viscosity of the ink is maintained at such a value that the ink can be ejected reliably.

In addition, the present invention can be applied to such apparatus where the ink is liquefied just before the ejection by the thermal energy as follows so that the ink is expelled from the orifices in the liquid state, and then begins to solidify on hitting the recording medium, thereby preventing the ink evaporation: the ink is transformed from solid to liquid state by positively utilizing the thermal energy which would otherwise cause the temperature rise; or the ink, which is dry when left in air, is liquefied in response to the thermal energy of the recording signal. In such cases, the ink may be retained in recesses or through holes formed in a porous sheet as liquid or solid substances so that the ink faces the electrothermal transducers as described in Japanese Patent Application Laying-open Nos. 56847/1979 or 71260/1985. The present invention is most effective when it uses the film boiling phenomenon to expel the ink.

Furthermore, the ink jet recording apparatus of the present invention can be employed not only as an image output terminal of an information processing device such as a computer, but also as an output device of a copying machine including a reader, and as an output device of a facsimile apparatus having a transmission and receiving function.

The present invention has been described in detail with respect to preferred embodiments, and it will now be apparent form the foregoing to those skilled in the art that changes and modifications may be made without departing from the invention in its broader aspects, and it is the intention, therefore, in the appended claims to cover all such changes and modifications as fall within the true spirit of the invention.

What is claimed is:

1. An ink-jet head having a plurality of printing elements each having two ends, and respectively corresponding to a plurality of ink ejection openings capable of ejecting ink droplets through said ink ejection openings by selectively inputting a drive signal to the ends of said printing elements, characterized in that:

an individual wiring individually connected to one of the ends of respective said printing elements and a common wiring commonly connected to an other end of respective said printing elements are formed in a single layer on a substrate;

a plurality of electrodes respectively connected to said individual wiring and said common wiring are provided on said substrate;

said electrode connected to said common wiring and said electrodes connected to said individual wiring each form a connecting portion to be connected to a driving circuit substrate for inputting of said drive signal; and said connecting portion of said electrode connected to said common wiring is located at a closer position to said printing elements than said connecting portions of said electrodes connected to said individual wiring.

2. An ink-jet head claimed in claim 1, wherein said ink jet ejection openings and said printing elements each have an alignment direction and wherein respective of said printing elements are arranged in substantially a same direction as the alignment direction of said ink ejection openings, and said electrodes are arranged on a plurality of lines extending substantially along the alignment direction of said printing elements.

3. An ink-jet head as claimed in claim 1, wherein said ink jet ejection openings and said printing elements each have an alignment direction and wherein respective of said printing elements are arranged in substantially a same direction as the alignment direction of said ink ejection openings, and a plurality of said electrodes connected to said individual wiring are arranged on a common line extending substantially perpendicular to the alignment direction of said printing elements.

4. An ink-jet head as claimed in claim 1, wherein said printing elements are electrothermal transducers generating a thermal energy for generating bubble in ink.

5. An ink-jet head as claimed in claim 1, which further comprises a driver circuit side substrate formed with a driver circuit outputting said drive signal of said printing elements, and said substrate and said driver circuit side substrate are coupled for outputting said drive signal to said electrodes.

6. An ink-jet head as claimed in claim 1, which further comprises a driver circuit side substrate formed with a driver circuit outputting said drive signal of said printing elements and being able to be coupled with said substrate, said driver circuit side substrate is provided with a first electrode to be crimped with said electrode connected to said common wiring of said substrate, a plurality of second electrodes to be crimped with respective of said electrodes connected to respective of said individual wiring of said substrate, a driver circuit side common wiring connecting said first electrode and said driver circuit, and a plurality of driver circuit side individual wiring connecting respective of said second electrodes and said driver circuit, respective of said second electrodes are arranged in a vicinity of said driver circuit, and said first electrode is arranged at a position distant from said driver circuit at a greater distance than that of said second electrode.

7. An ink-jet cartridge comprising:

an ink-jet head of claim 1; and an ink tank supplying an ink to said ink-jet head.

8. An ink-jet printing apparatus printing an image on a printing medium employing an ink-jet head capable of ejection of an ink, comprising:

an ink-jet head of claim 1; and shifting means for shifting said ink-jet head relative to said printing medium.

9. An ink-jet printing apparatus as claimed in claim 8, which further comprises:

a driver circuit side substrate formed with a driver circuit outputting said drive signal to said printing elements in said ink-jet head; and coupling means for releasably coupling said substrate and said driver circuit side substrate so that said drive signal is output to said electrodes of said substrate of said ink-jet head.

10. An ink-jet printing apparatus as claimed in claim 8, a driver circuit side substrate formed with a driver circuit outputting said drive signal to said printing elements in said ink-jet head and being able to be coupled with said substrate of said ink-jet head; and said driver circuit side substrate is provided with a first electrode to be crimped with said electrode connected to said common wiring of said substrate of said ink-jet head, a plurality of second electrodes to be crimped with respective of said electrodes connected to respective of said individual wiring of said substrate of said ink-jet head, a driver circuit side common wiring connecting said first electrode and said driver circuit, and a plurality of driver circuit side individual wiring connecting respective of said second electrodes and said driver circuit, respective of said second electrodes are arranged in a vicinity of said driver circuit, and said first electrode is arranged at a position distant from said driver circuit at a greater distance than that of said second electrode.

11. An ink-jet printing apparatus for printing an image on a printing medium employing an ink-jet head capable of ejecting an ink, comprising;

an ink jet head of claim 5; and shifting means for shifting said ink-jet head relative to said printing medium.

12. An ink-jet printing apparatus for printing an image on a printing medium employing an ink-jet head capable of ejecting an ink, comprising;

an ink jet cartridge of claim 7; and shifting means for shifting said ink-jet head relative to said printing medium.

13. An ink-jet printing apparatus as claimed in claim 12, which further comprises:

a driver circuit side substrate formed with a driver circuit outputting said drive signal to said printing elements in said ink-jet head; and coupling means for releasably coupling said substrate and said driver circuit side substrate so that said drive signal is output to said electrodes of said substrate of said ink-jet head.

14. An ink-jet printing apparatus as claimed in claim 12, a driver circuit side substrate formed with a driver circuit outputting said drive signal to said printing elements in said ink-jet head and being able to be coupled with said substrate of said ink-jet head; and said driver circuit side substrate is provided with a first electrode to be crimped with said electrode connected to said common wiring of said substrate of said ink-jet head, a plurality of second electrodes to be crimped with respective of said electrodes connected to respective of said individual wiring of said substrate of said ink-jet head, a driver circuit side common wiring connecting said first electrode and said driver circuit, and a plurality of driver circuit side individual wiring connecting respective of said second electrodes and said driver circuit, respective of said second electrodes are arranged in the vicinity of said driver circuit, and said first electrode is arranged at a position distant from said driver circuit at a greater distance than that of said second electrode.

15. An ink-jet printing apparatus as claimed in claim 8, wherein said shifting means includes a carriage detachably mounting said ink-jet head, means for shifting said carriage in a primary scanning direction and means for transporting said printing medium in an auxiliary scanning direction substantially perpendicular to said primary scanning direction.

* * * * *

UNITED STATES PATENT AND TRADEMARK OFFICE

CERTIFICATE OF CORRECTION

PATENT NO. : 6,132,031
DATED : October 17, 2000
INVENTOR(S) : Yasutomo Watanabe

It is certified that error appears in the above-identified patent and that said Letters Patent is hereby corrected as shown below:

Title page,
Item [56], References Cited, U.S. PATENT DOCUMENTS,

| | | | | |
|---|---|---|---|---|
| Insert: -- | 4,313,124 | 1/1982 | Hara | 347/57 |
| | 4,345,262 | 8/1982 | Shirato et al. | 347/56 |
| | 4,459,600 | 7/1984 | Sato et al. | 347/47 |
| | 4,558,333 | 12/1985 | Sugitani et al. | 347/65 |
| | 4,608,577 | 8/1986 | Hori | 347/66 |
| | 4,723,129 | 2/1988 | Endo et al. | 347/56 |
| | 5,227,812 | 7/1993 | Watanabe et al. | 347/50 |
| | 5,696,543 | 12/1997 | Koizumi et al. | 347/17 |
| | 5,576,748 | 11/1996 | Tamura | 347/58 -- |

Item [56], References Cited, FOREIGN PATENT DOCUMENTS,

| | | | |
|---|---|---|---|
| Insert: -- | FOREIGN PATENT DOCUMENTS | | |
| | 54-56847 | 5/1979 | Japan |
| | 59-123670 | 7/1984 | Japan |
| | 59-138461 | 8/1984 | Japan |
| | 60-71260 | 4/1985 | Japan -- |

Column 1,
Line 7, "fereinto" should read -- hereinto --.

Column 2,
Line 50, "complicate." should read -- complicated. --.

Column 6,
Line 51, "form" should read -- from --.

UNITED STATES PATENT AND TRADEMARK OFFICE

CERTIFICATE OF CORRECTION

PATENT NO. : 6,132,031
DATED : October 17, 2000
INVENTOR(S) : Yasutomo Watanabe

It is certified that error appears in the above-identified patent and that said Letters Patent is hereby corrected as shown below:

Column 9,
Line 54, "consists" should read -- consist --.

Signed and Sealed this

Sixteenth Day of April, 2002

*Attest:*

*Attesting Officer*

JAMES E. ROGAN
*Director of the United States Patent and Trademark Office*